US012365840B2

(12) United States Patent
Kaiser et al.

(10) Patent No.: US 12,365,840 B2
(45) Date of Patent: Jul. 22, 2025

(54) METHOD AND INSTALLATION FOR THE PRODUCTION OF HYDROCARBONS

(71) Applicant: LINDE GMBH, Pullach (DE)

(72) Inventors: Christian Kaiser, Munich (DE); Mario Sanktjohanser, Munich (DE); Christian Ziegler, Munich (DE)

(73) Assignee: LINDE GMBH, Pullach (DE)

( * ) Notice: Subject to any disclaimer, the term of this patent is extended or adjusted under 35 U.S.C. 154(b) by 293 days.

(21) Appl. No.: 17/786,821

(22) PCT Filed: Dec. 18, 2020

(86) PCT No.: PCT/EP2020/087014
§ 371 (c)(1),
(2) Date: Jun. 17, 2022

(87) PCT Pub. No.: WO2021/123160
PCT Pub. Date: Jun. 24, 2021

(65) Prior Publication Data

US 2023/0046854 A1 Feb. 16, 2023

(30) Foreign Application Priority Data

Dec. 19, 2019 (EP) ..... 19218125

(51) Int. Cl.
*C10G 9/16* (2006.01)
*C10G 9/20* (2006.01)
*C10G 9/36* (2006.01)

(52) U.S. Cl.
CPC ..... *C10G 9/16* (2013.01); *C10G 9/20* (2013.01); *C10G 9/36* (2013.01); *C10G 2300/4037* (2013.01); *C10G 2400/20* (2013.01)

(58) Field of Classification Search
None
See application file for complete search history.

(56) References Cited

U.S. PATENT DOCUMENTS 5,820,747 A * 10/1998 Lenglet ..... C10G 9/002 208/126
6,237,341 B1 5/2001 Koike et al.
(Continued)

FOREIGN PATENT DOCUMENTS

| | | | |
|---|---|---|---|
| CA | 926622 | A | 5/1973 |
| EP | 2096157 | A2 | 9/2009 |
| EP | 2772524 | A1 | 9/2014 |

OTHER PUBLICATIONS

PCT Patent Application PCT/EP2020/087014 International Search Report dated Mar. 25, 2021.

*Primary Examiner* — In Suk C Bullock
*Assistant Examiner* — Alyssa L Cepluch
(74) *Attorney, Agent, or Firm* — AVEK IP, LLC

(57) ABSTRACT

A process is disclosed for the production of hydrocarbons with removal of coke from a product stream. In a first mode, hydrocarbons and steam are subjected to steam cracking to obtain a cracked gas. The removal of coke from the steam is performed using a coke trap thus obtaining a coke-depleted cracking gas which is subjected to quench heat exchange in the first mode downstream of the coke trap, effecting cooling. Product stream is formed in the first operating mode using the cracked gas cooled in the quench heat exchange. The coke trap is emptied in a second mode using a stream extracted from a cracking furnace, bypassing the quench heat exchange, to obtain a coke stream. The coke stream in the second mode is passed to a coke collector.

11 Claims, 1 Drawing Sheet

(56) References Cited

U.S. PATENT DOCUMENTS

| | | | |
|---|---|---|---|
| 2005/0261532 | A1 | 11/2005 | Stell et al. |
| 2014/0024873 | A1 | 1/2014 | De Haan et al. |

* cited by examiner

METHOD AND INSTALLATION FOR THE PRODUCTION OF HYDROCARBONS

RELATED APPLICATIONS

The present application is a national stage application under 35 U.S.C. § 371 of International Application No. PCT/EP2020/087014, filed 18 Dec. 2020, which claims priority to European Patent Application No. 19218125.3, filed 19 Dec. 2019. The above referenced applications are hereby incorporated by reference in their entirety.

BACKGROUND

Steam cracking processes and plants have been known for a long time and are described extensively in technical literature. In this context, special reference is made to the article "Ethylene" in Ullmann's Encyclopedia of Industrial Chemistry, online edition, 2007, DOI 10.2002/14356007.a10_045.pub2.

For steam cracking, steam cracking plants (often also called ethylene plants) with so-called cracking furnaces are used. These cracking furnaces can also be provided in several groups and can be operated under different conditions, or they can be supplied with different feeds.

The so-called cracked gas withdrawn from a cracking furnace, which is initially present at a temperature of typically 750 to 875° C., must be cooled as rapidly as possible in order to bring the reactions to a standstill as fast as possible and thus prevent the excessive formation of undesired by-products. So-called quench heat exchangers are used to cool the cracked gas, which can be divided into primary and secondary quench heat exchangers. Different designs are also described in the technical literature.

The appropriately cooled cracked gas is subjected to a water and/or oil wash, depending on its composition, which depends in particular on the reaction feeds and cracking conditions used, followed by a compression and acid gas removal, as well as a fractionation operated at least partially at cryogenic temperatures, in order to recover the desired products, classically ethylene, from the product stream.

During the steam cracking of hydrocarbons, coke is often produced as a by-product, i.e. a carbonaceous solid which has little or no volatility and easily attaches to the walls of the steam cracking plant.

To remove such coke-containing deposits, the regular operation of the steam cracking plant can be interrupted, e.g. cyclically, as described in US 2005/261532 A1. During the interruption of the regular operation, instead of a feed stream containing the hydrocarbons to be cracked, a cleaning stream containing oxygen and/or steam can be introduced into the plant to oxidize the coke and convert it at least partially into gaseous residues that can be discharged from the plant.

US 2014/024873 A1 discloses the use of a coke trap that can be emptied during normal operation or in a standby mode. This is intended to protect a transfer line heat exchanger from contamination, taking into account a number of boundary conditions.

It is also possible, as described for example in CA 926622 A, to design certain parts of the plant in such a way that solids do not or only with difficulty accumulate there, for example for reasons of fluid mechanics. It is then possible to separate coke from the product flow downstream of these plant sections and to collect it, for example by reducing the flow velocity or by filtering and/or providing a collecting container. The coke separated in this way can then be removed from the plant, especially from the collecting container, for example during a plant revision.

The mentioned possibilities for the removal of coke from a steam cracking plant require the shutdown of the plant or the temporary suspension of a regular operation of the plant. Against this background, the disclosed embodiments face the task of improving the removal of coke as well as making it easier and more effective.

SUMMARY OF THE INVENTION

This task is solved by a process for the production of hydrocarbons using steam cracking and a plant for its implementation with the features of the independent claims. Advantageous variants and further embodiments are subject of the dependent claims as well as the following description.

A process for producing hydrocarbons proposed in accordance with embodiments comprises the removal of coke from a product stream containing the hydrocarbons and steam, wherein in a first mode of operation a feed fluid containing hydrocarbons and steam is subjected to steam cracking to obtain a cracked gas, wherein the removal of coke downstream of the steam cracking in the first mode of operation is performed using a coke trap and obtaining a coke-depleted cracked gas, wherein the coke-depleted cracked gas is subjected to a quench heat exchange in the first mode of operation downstream of the coke trap, effecting cooling, and wherein the product stream is formed in the first mode of operation using the cracked gas cooled by the quench heat exchange.

According to embodiments, the coke trap is emptied in a second mode of operation using a withdrawal stream withdrawn from a cracking furnace used for said steam cracking, bypassing the quench heat exchange, to obtain a coke stream, wherein the coke stream in the second mode of operation is passed to a coke collection.

Herein, the withdrawal stream is preferably passed through the coke trap in the second mode of operation and the withdrawal stream is hereby enriched, in particular as an effect of turbulences, with the coke retained in the coke trap, the coke stream thus being formed from the withdrawal stream and the coke retained in the coke trap as a coke-rich stream and being passed to the coke collection.

A steam cracking plant for producing a product stream containing low molecular weight hydrocarbon compounds, which is used in the process according to embodiments, comprises the cracking furnace, a quench heat exchanger, the coke trap and a coke collection device. Unless otherwise specified, the quench heat exchanger mentioned here and below is in particular a secondary quench heat exchanger which may be preceded by a primary quench heat exchanger. For the function and operation of primary and secondary quench heat exchangers, reference is made to the technical literature cited at the outset.

In the cracking furnace, a withdrawal stream is generated from a feed fluid containing hydrocarbons and/or steam. In particular, depending on the composition of the feed fluid, a cracked gas (also known as raw gas) can be generated. However, it is also possible to generate a withdrawal stream that is low in hydrocarbons or essentially free of hydrocarbons, especially in a regeneration or decoking operation. As mentioned above, a decoking operation to be carried out at regular intervals to remove the coke produced in the cracking tubes is common and necessary in conventional plants. Before or after this operating condition, an automated or manual step is added to the change-over process (cracking-decoking-cracking), which ensures the discharge of the coke (which does not adhere anymore to the cracking tube) accumulated during cracking. The medium used may be steam, a steam/air mixture, air or any other suitable gas, which in this case constitutes a withdrawal stream.

The coke trap comprises an inlet, which is, downstream of the cracking furnace and upstream of the quench heat exchanger, in fluid communication with a conduit carrying the withdrawal stream, or the cracked gas, and an outlet which is in fluid communication with the coke collection device, bypassing the quench heat exchanger. Furthermore, the coke trap is designed to retain the coke particles from the cracked gas via the inlet and to eject the coke particles via the outlet towards the coke collecting device using the withdrawal stream and obtaining the coke stream. The retention and ejection of the coke particles is carried out in particular in a periodic rotation. For this purpose, in the first operating mode, the coke trap is operated in such a way that coke particles are retained in it, but the remaining components are passed to the quench heat exchanger. In the second operating mode, which may be similar to the decoking operation mentioned above, the withdrawal stream, preferably at a high flow rate, is directed through the coke trap into the outlet in order to transport the coke retained during the first operating mode to the coke collecting device. Thus, in the second mode of operation, a smaller amount of the withdrawal stream, preferably none, is directed into the quench heat exchanger. This prevents coke formed in the cracking furnace from entering the quench heat exchanger. This is advantageous because the coke promotes ageing of plant components in contact with it in the form of corrosion and/or erosion or abrasion. The quench heat exchanger is designed to cool down (further) the withdrawal stream, especially the cracked gas.

In corresponding plants, it is particularly important to prevent the cracked gas from reaching the atmosphere or being mixed with the decoking air. Before or after the decoking operation (with the mentioned steam/air mixture as the withdrawal stream from the cracking furnace) the coke trap is in this connection emptied into the downstream system by means of a (partial) stream.

Advantageously, the steam cracking plant downstream of the quench heat exchanger includes a further coke trap having an inlet in fluid communication with a conduit carrying the withdrawal stream cooled in the quench heat exchanger and an outlet in fluid communication with the coke collection device. This allows the removal of unseparated coke from the cooled withdrawal stream in the coke trap located upstream of the quench heat exchanger, further increasing the purity of the product stream formed from the withdrawal stream, in particular the cracked gas.

The connection of the outlet of the coke trap located upstream of the quench heat exchanger with the coke collecting device opens advantageously upstream of the coke collecting device at a flat angle, in particular of about 45° or of 40° to 50°, into a conduit which in turn opens into the coke collecting device, in particular into the connection of the outlet of the further coke trap with the coke collecting device, in order to avoid damage due to abrasion or erosion in the conduits forming the connection between the respective trap with the coke collecting device and to reduce turbulence at this point.

The conduit carrying the withdrawal stream, according to the invention comprises, downstream of the cracking furnace and upstream of the quench heat exchanger, a kink or bend up to which the conduit runs in a first direction and from which the conduit runs in a second direction. The first and the second direction advantageously include an angle of e.g. 30° to 120°, especially 90°. The coke trap, the inlet of which is located downstream of the cracking furnace and upstream of the quench heat exchanger and is in fluid communication with the conduit carrying the withdrawal stream, in particular the cracked gas, is arranged in such a way that the first direction points to the inlet. In this way, coke particles entrained in the fast-flowing withdrawal stream can continue their trajectory due to inertia and enter the coke trap, while a particle-free or low-particle withdrawal stream flows further in the second direction.

The first direction, according to the invention, is a direction deviating from the vertical, in particular a horizontal direction or a direction inclined at an angle of at least 45° to the vertical, so that the coke particles collected in the coke trap do not fall out of the coke trap by gravity alone when its outlet is opened, but are selectively discharged from the coke trap by means of the stripping stream, in particular in a metered manner.

If the term "conduit" is used in this context, this does not necessarily mean a continuous pipe. A conduit in the sense understood here can also be several pipes or pipe sections which, possibly connected by non-pipe-shaped intermediate regions, form a continuous fluid channel.

The coke collection device advantageously includes a cyclone, a fire box and/or a flow brake. This allows the coke to be recovered as an additional valuable product if required, or alternatively to be burned, preferably with recovery of process heat, if no further material recycling is desired.

In addition to the cracking furnace and the elements mentioned above, a steam generator, a feed mixer and a cracked gas cooler are preferably part of the device according to embodiments. Also the mentioned primary quench heat exchanger can be additionally present and/or used as the cracked gas cooler. In some designs of embodiments, the cracking furnace with at least a part of these components can also be combined to form a furnace module, which simplifies the construction and maintenance of such a steam cracking plant and therefore makes it economically more favourable.

A steam cracking plant for the production of hydrocarbons comprising a cracking furnace, a quench heat exchanger, a coke trap and a coke collecting device are also the subject of embodiments, the coke trap having an inlet and an outlet, the inlet being located downstream of the cracking furnace and upstream of the quench heat exchanger and comprising a conduit, which carries a withdrawal stream generated in the cracking furnace from a feed fluid containing hydrocarbons and/or steam, wherein the outlet is fluid-connected to the coke collection device bypassing the quench heat exchanger, and wherein the coke trap is adapted to retain coke particles from the withdrawal stream in a first mode of operation. In accordance with embodiments, the coke trap is adapted to eject the coke particles in a second mode of operation towards the coke collecting device using the withdrawal stream and obtaining a coke stream. A conduit carrying the withdrawal stream runs from the cracking furnace in a first direction, has a bend, and runs downstream of the bend in a second direction. The inlet of the coke trap is located downstream of the bend in the first direction and the fluid connection of the inlet to the line starts from the bend. The first direction is a direction deviating from the vertical direction in the sense explained above.

For the advantages of such a device according to embodiments, reference is made to the above explanations regarding the process. Of course, these also apply analogously here.

Preferably the steam cracking plant as described is used for a described process.

Just for clarification, it should be noted that the quench heat exchanger(s) can be typical transfer line heat exchangers for steam cracking plants in which several pipelines are routed through a cooling area through which water or steam flows.

As already mentioned, in particular, a withdrawal stream can be provided for the above-mentioned emptying of the coke trap(s), which is essentially free of hydrocarbons, for example by appropriate control of the composition of the feed fluid. In this way, the gaseous components of the coke stream, which serve as a carrier medium for the coke particles, can be released into the natural atmosphere without significant environmental impact, after the coke particles have been removed from it in the coke collecting device. However, if a withdrawal stream containing cracked gas is used for the emptying of the coke trap according to embodiments, it must be ensured that the cracked gas from the coke stream does not enter the atmosphere, as this could cause environmental damage and is also economically unreasonable, as the cracked gas is the desired value product of steam cracking. Therefore, in such operating modes it is preferably separated from the coke stream and returned to the process, for example into the feed fluid, the withdrawal stream or the product stream.

Since only a few valves need to be set to switch between the two operating modes described, the procedure described is particularly suitable for automating the corresponding manufacturing and maintenance process. Compared to conventional systems as described at the outset, maintenance of systems according to embodiments is significantly shorter, for example because the coke trap is essentially self-draining and no manual emptying is necessary. Due to the reduced stress on the quench heat exchanger and the piping downstream of the coke trap, maintenance of these components is also less frequent.

The advantages of the disclosed embodiments include in particular a possible automation of the discharge process. Conventional internals (filters, containers, etc.) force the cracking furnace to shut down (usually once a year). Due to a simpler emptying within the scope of the disclosed embodiments, this can also be done more often, so that a reliable protection of the downstream system (also a fractionation part of the plant, downstream columns, pumps, etc.) is achieved.

Further aspects, embodiments and advantages of embodiments follow from the attached Figures as well as the following detailed description, which among others also refers to the Figures.

DETAILED DESCRIPTION

In the Figures, structurally or functionally corresponding elements are indicated with identical reference signs and are not repeatedly explained, just for the sake of clarity.

Figure 1:
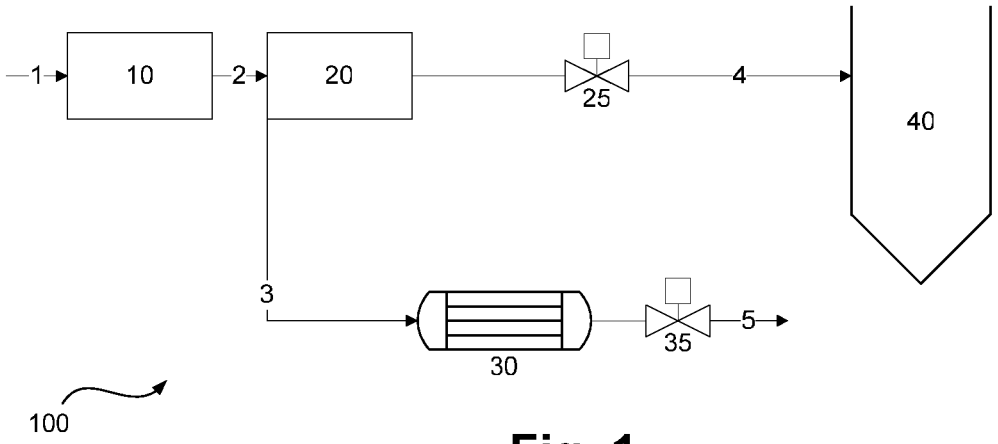
FIG. 1 shows an advantageous embodiment of a plant in the form of a schematic block diagram.

The steam cracking plant 100 as shown in FIG. 1 comprises a cracking furnace 10, a coke trap 20, a quench heat exchanger 30 and a coke collector 40.

One or more feed fluids 1, of which at least one contains hydrocarbons and at least one contains water molecules, are fed into the cracking furnace 10. In the cracking furnace, the hydrocarbons react at least partially with the water molecules to form a cracked gas, which typically contains coke particles in addition to low-molecular hydrocarbon compounds. The cracked gas is discharged from the cracking furnace 10 through a conduit 2 and passes through the coke trap 20. For example, the conduit 2 can have a bend of 30° to 1200, for example essentially 900, immediately upstream of the coke trap 20, so that the cracked gas is guided in the conduit towards the coke trap 20 before the bend, but directly away from the coke trap 20 after the bend. The coke trap 20 has an inlet in the direction of the cracking furnace 10 which is open to fluids in relation to the conduit, i.e. it is in fluid connection with the conduit 2 out of the cracking furnace 10. Due to the higher inertia of the coke particles compared to the gaseous molecules, especially the low-molecular hydrocarbon compounds, of the cracked gas, the coke particles move largely linearly into the inlet of the coke trap, while the gaseous components of the cracked gas, especially the low-molecular hydrocarbon compounds, follow the bend preferentially. As a result, the cracked gas is depleted of coke in the bend of the conduit before it is further directed through conduit 3 towards quench heat exchanger 30. Coke is initially retained in the coke trap 20.

The cracked gas is cooled in the quench heat exchanger 30, for example against the one or more feed fluids 1, and withdrawn from the system 100 as product stream 5 via a product valve 35.

At certain times the coke trap 20 is emptied. For this purpose, a control valve 25, which closes an outlet of the coke trap 20 at an end facing away from the cracking furnace 10, is opened. At the same time, the product valve 35, for example, can be closed completely or partially and/or a pressure of a withdrawal stream flowing through conduit 2 can be increased to increase a flow through the coke trap 20. The outlet of the coke trap 20 is in fluid communication with the coke collecting device 40, as described above. As a result, the withdrawal stream flows through the coke trap 20 and, especially due to turbulence, strongly enriches itself with the coke retained therein. In this way, a coke-rich stream 4 is formed from the withdrawal stream and the coke retained in the coke trap 20, which is led to the coke collecting device 40. At the end of an emptying period, the control valve 25 is closed again and, if necessary, the product valve 35 is opened again and/or the pressure of the withdrawal stream is reduced again.

In particular, it may be provided that the cracking furnace 10 is basically operated at a pressure level which corresponds to the natural atmospheric pressure and that the withdrawal stream 2 is compressed to a pressure level in the range between 1.2 and 2.5 times the natural atmospheric pressure when the pressure is increased. For this purpose, for example, the pressure in the cracking furnace 10 itself can be increased or the withdrawal stream leaving the cracking furnace 10 can be subjected to compression downstream of the cracking furnace 10.

The points in time at which the coke trap is emptied in the described manner can, for example, be selected at regular, especially predetermined, intervals. In certain configurations of the disclosed embodiments, it may also be provided that the points of time are selected depending on a degree of filling of the coke trap 20 or a quality parameter of the cracked gas depleted of coke, for example in a regulated or controlled manner. For this purpose, sensors in or at the coke trap can be provided, for example, which monitor the degree of filling. For example, these can be light barriers that monitor a visual path through the coke trap 20 and define an upper threshold value of the filling level as exceeded if the visual path is blocked. Another possibility to determine the filling degree of the coke trap 20 can be a scale in the area of the geodetic bottom of the coke trap 20, which defines the upper threshold value of the filling degree as exceeded when the mass of the trap is predetermined. To monitor the quality parameter of the coke-poor cracked gas, for example, sensors are conceivable which measure a turbidity of the gas of which the coke-poor cracked gas is composed. If a predetermined threshold turbidity is exceeded, this indicates that not enough coke particles are retained in the coke trap 20, so that it is necessary to empty the coke trap 20 in order to increase its capacity and effectiveness again. This should be seen as a purely exemplary list of possible monitoring techniques, although other suitable parameters can also be monitored to determine a reasonable time for emptying coke trap 20. This means that the emptying of coke trap 20 is only carried out when it is actually necessary, which is economically advantageous.

Especially in case of direct monitoring of the filling level of coke trap 20, the emptying time can also be adjusted, especially in a controlled or regulated manner. For this purpose e.g. a lower threshold value can be defined as being undercut if for example a predetermined mass is undercut or a second light barrier, which is positioned closer to the geodetic bottom of the coke trap 20 than the one described above, recognizes a visual path through the volume of the coke trap 20 as free. Thus, the emptying of the coke trap is carried out in a time as short as possible and as long as necessary, which has a positive effect on the overall efficiency and the yield of the plant 100.

The described periodic emptying of the coke trap 20 will advantageously reduce the total amount of coke contained in plant 100 compared to the prior of the art. This reduces the probability of the retained coke igniting or, in case of ignition, the fire load, which increases the plant safety.

Figure 2:
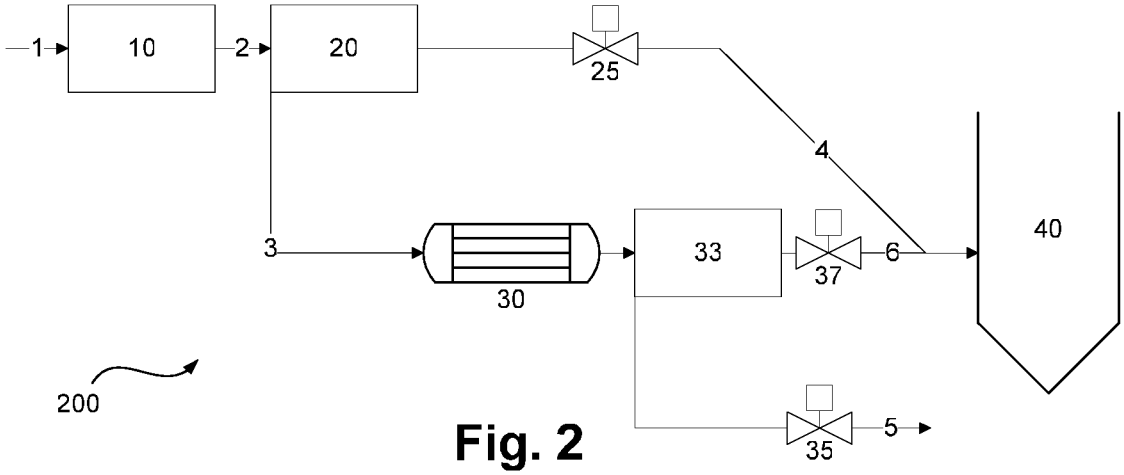
FIG. 2 shows another advantageous embodiment of a plant in a schematic representation.

The plant 200 shown in FIG. 2, in comparison to plant 100, has an additional coke trap 33, located downstream of the quench heat exchanger, with an associated additional control valve or decoking gas valve 37. The operating principle of this further coke trap 33 is identical to that of the coke trap 20. The separation of coke particles is again based on the higher inertia of the coke particles compared to the gaseous components of the cracked gas. The emptying of the further coke trap 33 is done in a similar way by opening the further control valve 37 and advantageously by closing the other valves 25, 35 of the plant 200 and preferably by increasing the pressure of the withdrawal stream at the same time. By separating further coke particles in the further coke trap 33, the purity of the product stream 5 can be further increased.

Advantageously, the coke streams 4 from the coke trap 20 and 6 from the further coke trap 33 are passed together into the coke collecting device 40. This allows an existing plant to be retrofitted with the coke trap 20 very easily without having to intervene significantly in the piping of the other plant components 30, 33, 40.

As shown in FIG. 2, it is particularly preferable to design the inlet of the coke stream 4 into the conduit of the coke stream 6 at a flat angle, especially an angle of about 45°. This reduces abrasion of the conduit wall, especially in relation to the point of introduction, so that this wall can be designed with less material. This in turn is particularly advantageous for retrofitting, since existing pipelines may not have been designed for such lateral feed and would otherwise have to be rebuilt. According to the embodiment described here, this is advantageously not necessary, so that existing pipelines can continue to be used or, in the case of a new construction of such a plant 200, conventionally dimensioned pipelines can be used. In addition, this non-vertical feed prevents the formation of a dynamic pressure, so that no or significantly fewer particles are deposited at the discharge point.

In alternative configurations of the plant according to the disclosed embodiments, it may also be provided that each coke trap 20, 33 has its own conduit from its respective outlet to the coke collecting device 40. Thus, when laying the respective conduits, it is not necessary to take into account the course of the other conduit, which facilitates the overall design of the plant. It can also be provided that for certain coke traps 20, 33 a common coke collecting device is provided, while other coke traps 20, 33 are assigned a dedicated coke collecting device 40. For example, it is conceivable that several plants 200 are operated in parallel and all coke traps 20 are emptied into a first coke collecting device 40, while all other coke traps 33 are emptied into a second coke collecting device 40. In this way, for example, a separation of the coke particles into different size fractions can be realized, since the flow velocities in front of the coke trap 20 and in front of the further coke trap 33 can differ and thus particles of different sizes can be retained in the respective coke traps 20, 33.

Regardless of the assignment to specific coke traps 20, 33, the coke collector 40 can be designed using a cyclone, a fire box and/or a flow brake. The functional principles of these components are only briefly outlined below for better understanding: the respective coke stream 4, 6 can be introduced into a cyclone, especially tangentially. The inert coke is thus separated from the less inert components of the coke stream in a radially outer area of the cyclone, in particular at a cylinder wall, or is slowed down there by friction and sinks to a bottom of the cyclone which is geodetically located at the bottom. From this bottom, the coke can be removed from the cyclone. In a fire box, coke particles of the coke stream 4, 6 are at least partially burned and/or sintered. This is particularly advantageous if the coke is not to be used as a by-product. The combustion heat can be taken from the fire box and used to operate the plant 100, 200, for example to preheat the feed fluid 1. A flow brake reduces the flow velocity of the coke flow 4, 6 and thus enables the usually denser coke particles to be separated from the other components of the coke flow 4, 6.

Especially in cases where the constituents of the coke stream 4, 6, especially gaseous components of the cracked gas used to form the coke stream 4, 6, are not chemically modified in the coke collector 40, it may be advantageous to return the gaseous constituents to the one or more feed fluids 1, the conduit 2, the coke-poor cracked gas in conduit 3 or the product stream 5. This increases the overall yield and increases the efficiency of the plant 100, 200.

As explained at the beginning, it can also be advantageous, especially during emptying times, to provide a withdrawal stream that is low in cracked gas or free of it. Thus, measures for the separation and recirculation of the gaseous components of the coke stream can be omitted, which has a positive effect on the necessary investment costs.

In the design of plant 100 as shown in FIG. 1, the control valve 37 or a corresponding coke flow 6 may also be necessary or advantageous, although not explicitly illustrated, to maintain a regular decoking path, so that only the discharge system 40 can be installed separately or twice. This makes it possible to produce coke as a product (e.g. via dry coke extraction).

The invention claimed is:

1. A process for removal of coke from a cracked gas stream in a steam cracking plant, the process comprising:

in a first operating mode:

steam cracking a feed containing hydrocarbons and steam in a cracking furnace to obtain a cracked gas stream comprising coke and hydrocarbons;

passing the cracked gas stream to a downstream coke trap to remove coke and obtain a coke-depleted cracked gas; and subjecting the coke-depleted cracked gas to heat exchange downstream of the coke trap to obtain a product gas stream comprising hydrocarbons; and in a second operating mode:

emptying the coke trap by passing a withdrawal stream comprising steam from the cracking furnace through the coke trap, forming a coke stream;

bypassing the quench heat exchange with the coke stream; and passing the coke stream to a coke collecting device;

wherein:

the cracked gas, downstream from the steam cracking, is sent via a conduit in a first direction, around a bend, and in a second direction downstream of the bend;

an inlet of the coke trap is arranged downstream of the bend in the first direction and a fluid connection from the conduit to the inlet starts from the bend;

an outlet of the coke trap is arranged in the first direction; and the first direction is a direction deviating from the vertical direction by at least 45°.

2. The process according to claim 1, wherein:

the inlet of the coke trap is arranged upstream of the quench heat exchanger and is fluidly connected to a conduit carrying the withdrawal stream;

the outlet of the coke trap is fluidly connected by a conduit to the coke collecting device.

3. The process according to claim 2, wherein, downstream of the quench heat exchanger, an outlet of a further coke trap is fluidly connected by a conduit to the coke collecting device.

4. The process according to claim 3, wherein the conduit connecting the coke trap to the coke collecting device opens at a shallow angle, in the range of 40° to 50°, into the conduit connecting the further coke trap to the coke collecting device.

5. The process according to claim 2, wherein the coke collecting device comprises one or more of a cyclone, a fire box and a flow brake.

6. The process according to claim 2, wherein the steam cracking plant further comprises one or more devices selected from the group consisting of a steam generator, a feed mixer, a reaction vessel, a cracked gas cooler, and a primary quench heat exchanger.

7. The process according to claim 2, wherein the first and the second direction enclose an angle in the range of 30° to 120°.

8. The process according to claim 7, wherein the first and the second direction enclose an angle in the range of 80° to 100°.

9. The process according to claim 8, wherein the first and the second direction enclose an angle of about 90°.

10. The process according to claim 4, wherein the conduit connecting the coke trap to the coke collecting device opens at a shallow angle of about 45° into the conduit connecting the further coke trap to the coke collecting device.

11. A steam cracking plant for the production of hydrocarbons comprising a cracking furnace, a quench heat exchanger, a coke trap and a coke collecting device, wherein the steam cracking plant is configured to perform the process of claim 1, and wherein:

the coke trap has an inlet and an outlet, wherein:

the inlet is arranged downstream of the cracking furnace and upstream of the quench heat exchanger and is fluidly connected to a conduit carrying a withdrawal stream generated in the cracking furnace from a feed fluid containing hydrocarbons and/or steam;

the outlet is fluidly connected to the coke collecting device, bypassing the quench heat exchanger;

in a first operating mode, the coke trap is adapted to retain coke particles from the withdrawal stream; and in a second operating mode, the coke trap is adapted to eject the coke particles in the direction of the coke collecting device using the withdrawal stream to obtain a coke stream;

a conduit carrying the withdrawal stream runs from the cracking furnace in a first direction, has a bend, and runs downstream of the bend in a second direction;

the inlet of the coke trap is arranged downstream of the bend in the first direction and the fluid connection of the inlet to the conduit starts from the bend;

the outlet of the coke trap is arranged in the first direction; and the first direction is a direction deviating from the vertical direction by at least 45°.

* * * * *